US006715299B2

(12) United States Patent
Kim et al.

(10) Patent No.: US 6,715,299 B2
(45) Date of Patent: Apr. 6, 2004

(54) REFRIGERATOR FOR COSMETICS AND METHOD OF CONTROLLING THE SAME

(75) Inventors: Yoon-Young Kim, Suwon (KR); Jae-Seung Lee, Suwon (KR); Byung-Young Kang, Seoul (KR); So-Yeon Sim, Seoul (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/114,308

(22) Filed: Apr. 3, 2002

(65) Prior Publication Data

US 2003/0084670 A1 May 8, 2003

(30) Foreign Application Priority Data

Oct. 19, 2001 (KR) ..... 2001-64803
Apr. 3, 2002 (KR) ..... 2002-18124

(51) Int. Cl.[7] ..... F25D 11/00
(52) U.S. Cl. ..... 62/3.6; 62/3.7
(58) Field of Search ..... 62/331, 3.6, 3.2, 62/3.4, 457.9

(56) References Cited

U.S. PATENT DOCUMENTS 3,732,702 A * 5/1973 Desch ..... 62/3
3,801,284 A * 4/1974 Meckler ..... 23/263
5,353,600 A * 10/1994 Merritt et al. ..... 62/3.7
5,505,046 A * 4/1996 Nelson et al. ..... 62/3.6
5,515,683 A * 5/1996 Kessler ..... 62/3.7
5,524,440 A 6/1996 Nishioka et al.
6,003,319 A * 12/1999 Gilley et al. ..... 62/3.7
6,021,642 A * 2/2000 Guinn ..... 62/3.6
6,038,865 A * 3/2000 Watanabe et al. ..... 62/3.6
6,122,918 A * 9/2000 Johnson, Jr. ..... 62/3.2
6,134,906 A * 10/2000 Eastman ..... 62/331
6,294,721 B1 * 9/2001 Oravetz et al. ..... 136/242
6,301,910 B1 * 10/2001 Noritake et al. ..... 62/187
6,308,519 B1 * 10/2001 Bielinski ..... 62/3.6
6,384,380 B1 * 5/2002 Faries, Jr. et al. ..... 219/385
6,401,462 B1 * 6/2002 Bielinski ..... 62/3.7
6,481,213 B2 * 11/2002 Carr et al. ..... 62/3.2

* cited by examiner

*Primary Examiner*—Melvin Jones
(74) *Attorney, Agent, or Firm*—Staas & Halsey LLP

(57) ABSTRACT

A refrigerator for cosmetics that has a storage chamber and a cooling unit to cool the storage chamber. The refrigerator includes an input unit, a storage unit, a temperature detecting unit and a control unit. The input unit receives one or more storage conditions from a user. The storage unit stores storage temperatures predetermined to correspond to possible storage conditions. The temperature detects unit detects a temperature of the storage chamber. The control unit controls an operation of the cooling unit on the basis of the storage conditions inputted through the input unit, a corresponding storage temperature stored in the storage unit and the temperature of the storage chamber detected by the temperature detecting unit.

31 Claims, 26 Drawing Sheets

FIG 5

| Evaluation item | | 10℃ | 15℃ | 20℃ | 25℃ | 30℃ |
|---|---|---|---|---|---|---|
| Appearance | Luster | 9.80 | 10.50 | 9.20 | 8.60 | 7.50 |
| | Viscosity | 11.40 | 10.50 | 9.00 | 8.60 | 7.60 |
| | Mildness | 9.10 | 9.50 | 8.50 | 7.60 | 7.10 |
| Pick-up | Firmness | 8.00 | 7.00 | 6.00 | 5.00 | 4.00 |
| | Adhesiveness | 7.20 | 6.50 | 5.40 | 4.20 | 3.50 |
| | cohesiveness | 7.30 | 6.40 | 5.60 | 4.40 | 3.20 |
| Rub-out | Slipperiness 1 | 6.30 | 6.70 | 6.50 | 6.60 | 6.60 |
| | Oiliness | 5.50 | 6.00 | 6.50 | 7.00 | 7.70 |
| | Spreadability | 8.20 | 8.50 | 7.80 | 7.40 | 8.50 |
| | Thickness | 9.20 | 8.50 | 7.80 | 6.80 | 5.40 |
| | Moistness | 8.50 | 8.80 | 7.50 | 6.60 | 5.40 |
| | Slipperiness 2 | 4.50 | 5.50 | 5.20 | 4.20 | 5.60 |
| | Absorption rate | 8.50 | 10.50 | 9.20 | 7.80 | 5.60 |
| After-feel | Gloss | 7.50 | 8.60 | 7.40 | 6.40 | 5.30 |
| | Moist feeling | 10.00 | 11.00 | 9.20 | 8.40 | 5.60 |
| | oiliness | 4.20 | 4.50 | 5.50 | 6.60 | 7.60 |
| | Smoothness | 8.50 | 9.20 | 8.20 | 7.60 | 8.00 |
| | Stickiness | 5.50 | 5.30 | 6.50 | 7.00 | 7.50 |
| | Residual feeling | 9.20 | 8.50 | 7.80 | 7.60 | 7.20 |
| Total feeling | Preference (Perfect score:5) | 4 | 5 | 4 | 3 | 2 |

FIG 6

1)Spring

| Evaluation item | | 10℃ | 13℃ | 15℃ | 17℃ | 19℃ |
|---|---|---|---|---|---|---|
| Appoarance | Luster | 9.80 | 10.00 | 10.50 | 10.00 | 9.20 |
| | Viscosity | 11.40 | 10.80 | 10.50 | 9.70 | 9.00 |
| | Mildness | 9.10 | 9.20 | 9.50 | 8.80 | 8.50 |
| Pick-up | Firmness | 8.00 | 7.50 | 7.00 | 6.50 | 6.00 |
| | Adhesiveness | 7.20 | 6.80 | 6.50 | 5.70 | 5.40 |
| | cohesiveness | 7.30 | 6.80 | 6.40 | 6.10 | 5.60 |
| Rub-out | Slipperiness 1 | 6.30 | 6.40 | 6.70 | 6.50 | 6.50 |
| | Oiliness | 5.50 | 5.80 | 6.00 | 6.20 | 6.50 |
| | Spreadability | 8.20 | 8.30 | 8.50 | 8.10 | 7.80 |
| | Thickness | 9.20 | 8.80 | 8.50 | 8.00 | 7.80 |
| | Moistness | 8.50 | 8.60 | 8.80 | 8.20 | 7.50 |
| | Slipperiness 2 | 4.50 | 4.70 | 5.50 | 5.40 | 5.20 |
| | Absorption rate | 8.50 | 9.20 | 10.50 | 9.60 | 9.20 |
| After-feel | Gloss | 7.50 | 7.80 | 8.60 | 7.80 | 7.40 |
| | Moist feeling | 10.00 | 10.50 | 11.00 | 10.20 | 9.20 |
| | oiliness | 4.20 | 4.30 | 4.50 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.50 | 8.20 | 7.80 |
| Total feeling | Preference (Perfect score:5) | 3 | 4 | 5 | 4 | 2 |

FIG 7

2)summer

| Evaluation item | | 10℃ | 13℃ | 15℃ | 17℃ | 19℃ |
|---|---|---|---|---|---|---|
| Appearance | Luster | 10.00 | 10.50 | 10.00 | 9.20 | 8.50 |
| | Viscosity | 10.80 | 10.50 | 9.70 | 9.00 | 8.00 |
| | Mildness | 9.20 | 9.50 | 8.80 | 8.50 | 7.80 |
| Pick-up | Firmness | 7.50 | 7.00 | 6.50 | 6.00 | 5.10 |
| | Adhesiveness | 6.80 | 6.50 | 5.70 | 5.40 | 4.50 |
| | cohesiveness | 6.80 | 6.40 | 6.10 | 5.60 | 4.50 |
| Rub-out | Slipperiness 1 | 6.40 | 6.70 | 6.50 | 6.50 | 7.20 |
| | Oiliness | 5.80 | 6.00 | 6.20 | 6.50 | 7.60 |
| | Spreadability | 8.30 | 8.50 | 8.10 | 7.80 | 7.50 |
| | Thickness | 8.80 | 8.50 | 8.00 | 7.80 | 6.50 |
| | Moistness | 8.60 | 8.80 | 8.20 | 7.50 | 6.70 |
| | Slipperiness 2 | 4.70 | 5.50 | 5.40 | 5.20 | 4.40 |
| | Absorption rate | 9.20 | 10.50 | 9.60 | 9.20 | 8.70 |
| After-feel | Gloss | 7.80 | 8.60 | 7.80 | 7.40 | 6.50 |
| | Moist feeling | 10.50 | 11.00 | 10.20 | 9.20 | 8.00 |
| | oiliness | 4.30 | 4.50 | 5.10 | 5.50 | 6.70 |
| | Smoothness | 8.70 | 9.20 | 8.60 | 8.20 | 8.00 |
| | Stickiness | 5.40 | 5.30 | 6.20 | 6.50 | 7.50 |
| | Residual feeling | 8.80 | 8.50 | 8.20 | 7.80 | 6.70 |
| Total feeling | Preference (Perfect score:5) | 4 | 5 | 4 | 3 | 2 |

FIG 8

3)Fall

| Evaluation Item | | 10℃ | 13℃ | 15℃ | 17℃ | 19℃ |
|---|---|---|---|---|---|---|
| Appearance | Luster | 9.80 | 10.00 | 10.50 | 10.00 | 9.20 |
| | Viscosity | 11.40 | 10.80 | 10.50 | 9.70 | 9.00 |
| | Mildness | 9.10 | 9.20 | 9.50 | 8.80 | 8.50 |
| Pick-up | Firmness | 8.00 | 7.50 | 7.00 | 6.50 | 6.00 |
| | Adhesiveness | 7.20 | 6.80 | 6.50 | 5.70 | 5.40 |
| | cohesiveness | 7.30 | 6.80 | 6.40 | 6.10 | 5 60 |
| Rub-out | Slipperiness 1 | 6.30 | 6.40 | 6.70 | 6.50 | 6.50 |
| | Oiliness | 5.50 | 5.80 | 6.00 | 6.20 | 6.50 |
| | Spreadability | 8.20 | 8.30 | 8.50 | 8.10 | 7.80 |
| | Thickness | 9.20 | 8.80 | 8.50 | 8.00 | 7.80 |
| | Moistness | 8.50 | 8.60 | 8.80 | 8.20 | 7.50 |
| | Slipperiness 2 | 4.50 | 4.70 | 5.50 | 5.40 | 5.20 |
| | Absorption rate | 8.50 | 9.20 | 10.50 | 9.60 | 9.20 |
| After-feel | Gloss | 7.50 | 7.80 | 8.60 | 7.80 | 7.40 |
| | Moist feeling | 10.00 | 10.50 | 11.00 | 10.20 | 9.20 |
| | oiliness | 4.20 | 4.30 | 4.50 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.50 | 8.20 | 7.80 |
| Total feeling | Preference (Perfect score:5) | 3 | 4 | 5 | 4 | 2 |

FIG 9

4)Winter

| Evaluation item | | 12℃ | 14℃ | 16℃ | 18℃ | 20℃ |
|---|---|---|---|---|---|---|
| Appearance | Luster | 9.50 | 10.00 | 10.50 | 10.00 | 9.20 |
| | Viscosity | 11.40 | 10.80 | 10.50 | 9.70 | 9.00 |
| | Mildness | 9.10 | 9.30 | 9.50 | 8.80 | 8.50 |
| Pick-up | Firmness | 8.00 | 7.70 | 7.00 | 6.50 | 6.00 |
| | Adhesiveness | 7.20 | 6.80 | 6.50 | 5.70 | 5.40 |
| | cohesiveness | 7.60 | 6.80 | 6.40 | 6.10 | 5.60 |
| Rub-out | Slipperiness 1 | 6.30 | 6.40 | 6.70 | 6.50 | 6.50 |
| | Oiliness | 5.50 | 5.80 | 6.00 | 6.20 | 6.50 |
| | Spreadability | 7.50 | 7.80 | 8.50 | 8.10 | 7.80 |
| | Thickness | 9.20 | 8.80 | 8.50 | 8.00 | 7.80 |
| | Moistness | 8.50 | 8.70 | 9.00 | 8.20 | 7.50 |
| | Slipperiness 2 | 4.50 | 4.90 | 5.50 | 5.40 | 5.20 |
| | Absorption rate | 8.50 | 9.20 | 10.80 | 9.60 | 9.20 |
| After-feel | Gloss | 7.50 | 7.80 | 8.60 | 7.80 | 7.40 |
| | Moist feeling | 10.00 | 10.50 | 11.20 | 10.20 | 9.20 |
| | oiliness | 4.20 | 4.50 | 4.80 | 5.10 | 5.50 |
| | Smoothness | 8.50 | 8.90 | 10.10 | 8.60 | 8.20 |
| | Stickiness | 5.50 | 5.40 | 5.10 | 6.20 | 6.50 |
| | Residual feeling | 9.20 | 8.90 | 8.50 | 8.20 | 7.80 |
| Total feeling | Proference (Perfect score:5) | 3 | 4 | 5 | 4 | 2 |

FIG 10

1)Spring

| Evaluation Item | | 13℃ | 15℃ | 17℃ | 19℃ | 21℃ |
|---|---|---|---|---|---|---|
| Appearance | Luster | 9.90 | 10.20 | 10.80 | 10.00 | 9.00 |
| | Viscosity | 11.60 | 10.80 | 10.50 | 9.70 | 9.00 |
| | Mildness | 9.10 | 9.20 | 9.80 | 8.80 | 8.50 |
| Pick-up | Firmness | 8.00 | 7.50 | 7.00 | 6.50 | 6.00 |
| | Adhesiveness | 7.60 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.70 | 5.80 | 6.00 | 6.30 | 6.50 |
| | Spreadability | 8.00 | 8.30 | 8.50 | 8.10 | 7.80 |
| | Thickness | 9.10 | 8.80 | 8.70 | 8.30 | 7.80 |
| | Moistness | 8.50 | 8.60 | 9.00 | 8.20 | 7.50 |
| | Slipperiness 2 | 4.50 | 4.70 | 5.70 | 5.40 | 5.20 |
| | Absorption rate | 8.50 | 9.20 | 10.80 | 9.60 | 9.20 |
| After-feel | Gloss | 7.50 | 7.80 | 8.70 | 7.80 | 7.40 |
| | Moist feeling | 10.00 | 10.50 | 11.50 | 10.20 | 9.20 |
| | oiliness | 4.20 | 4.30 | 4.70 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 11

2)Summer

| Evaluation Item | | 10℃ | 13℃ | 15℃ | 17℃ | 19℃ |
|---|---|---|---|---|---|---|
| Appearance | Luster | 9.80 | 10.00 | 10.50 | 10.00 | 9.20 |
| | Viscosity | 11.40 | 10.80 | 10.50 | 9.70 | 9.00 |
| | Mildness | 9.10 | 9.20 | 9.50 | 8.80 | 8.50 |
| Pick-up | Firmness | 8.00 | 7.50 | 7.00 | 6.50 | 6.00 |
| | Adhesiveness | 7.20 | 6.80 | 6.50 | 5.70 | 5.40 |
| | cohesiveness | 7.30 | 6.80 | 6.40 | 6.10 | 5.60 |
| Rub-out | Slipperiness 1 | 6.30 | 6.40 | 6.70 | 6.50 | 6.50 |
| | Oiliness | 5.50 | 5.80 | 6.00 | 6.20 | 6.50 |
| | Spreadability | 8.20 | 8.30 | 8.50 | 8.10 | 7.80 |
| | Thickness | 9.20 | 8.80 | 8.50 | 8.00 | 7.80 |
| | Moistness | 8.50 | 8.60 | 8.80 | 8.20 | 7.50 |
| | Slipperiness 2 | 4.50 | 4.70 | 5.50 | 5.40 | 5.20 |
| | Absorption rate | 8.50 | 9.20 | 10.50 | 9.60 | 9.20 |
| After-feel | Gloss | 7.50 | 7.80 | 8.60 | 7.80 | 7.40 |
| | Moist feeling | 10.00 | 10.50 | 11.00 | 10.20 | 9.20 |
| | oiliness | 4.20 | 4.30 | 4.50 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.50 | 8.20 | 7.80 |
| Total feeling | Preference (Perfect score:5) | 3 | 4 | 5 | 4 | 2 |

FIG 12

3)Fall

| Evaluation item | | 13℃ | 15℃ | 17℃ | 19℃ | 21℃ |
|---|---|---|---|---|---|---|
| Appearance | Luster | 9.90 | 10.20 | 10.80 | 10.00 | 9.00 |
| | Viscosity | 11.60 | 10.80 | 10.50 | 9.70 | 9.00 |
| | Mildness | 9.10 | 9.20 | 9.80 | 8.80 | 8.50 |
| Pick-up | Firmness | 8.00 | 7.50 | 7.00 | 6.50 | 6.00 |
| | Adhesiveness | 7.60 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.70 | 5.80 | 6.00 | 6.30 | 6.50 |
| | Spreadability | 8.00 | 8.30 | 8.50 | 8.10 | 7.80 |
| | Thickness | 9.10 | 8.80 | 8.70 | 8.30 | 7.80 |
| | Moistness | 8.50 | 8.60 | 9.00 | 8.20 | 7.50 |
| | Slipperiness 2 | 4.50 | 4.70 | 5.70 | 5.40 | 5.20 |
| | Absorption rate | 8.50 | 9.20 | 10.80 | 9.60 | 9.20 |
| After-feel | Gloss | 7.50 | 7.80 | 8.70 | 7.80 | 7.40 |
| | Moist feeling | 10.00 | 10.50 | 11.50 | 10.20 | 9.20 |
| | oiliness | 4.20 | 4.30 | 4.70 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 13

4)Winter

| Evaluation item | | 14℃ | 16℃ | 18℃ | 20℃ | 22℃ |
|---|---|---|---|---|---|---|
| Appearance | Luster | 9.50 | 10.00 | 10.30 | 10.00 | 9.20 |
| | Viscosity | 11.40 | 10.80 | 10.30 | 9.70 | 9.00 |
| | Mildness | 9.10 | 9.30 | 9.90 | 8.80 | 8.50 |
| Pick-up | Firmness | 8.00 | 7.70 | 7.00 | 6.50 | 6.00 |
| | Adhesiveness | 7.20 | 6.80 | 6.10 | 5.70 | 5.40 |
| | cohesiveness | 7.60 | 6.80 | 6.50 | 6.10 | 5.60 |
| Rub-out | Slipperiness 1 | 6.30 | 6.40 | 6.70 | 6.50 | 6.50 |
| | Oilness | 5.50 | 5.80 | 6.00 | 6.20 | 6.50 |
| | Spreadability | 7.10 | 7.80 | 8.90 | 8.10 | 7.80 |
| | Thickness | 9.20 | 8.80 | 8.50 | 8.00 | 7.80 |
| | Moistness | 8.20 | 8.70 | 9.00 | 8.20 | 7.50 |
| | Slipperiness 2 | 4.50 | 4.90 | 5.80 | 5.40 | 5.20 |
| | Absorption rate | 8.00 | 9.20 | 10.80 | 9.60 | 9.20 |
| After-feel | Gloss | 7.10 | 7.80 | 8.60 | 7.80 | 7.40 |
| | Moist feeling | 10.00 | 10.50 | 11.40 | 10.20 | 9.20 |
| | oilness | 4.20 | 4.50 | 5.00 | 5.10 | 5.50 |
| | Smoothness | 8.50 | 8.90 | 10.10 | 8.60 | 8.20 |
| | Stickiness | 5.50 | 5.40 | 5.30 | 6.20 | 6.50 |
| | Residual feeling | 9.50 | 8.90 | 8.30 | 8.20 | 7.80 |
| Total feeling | Preference (Perfect score:5) | 3 | 4 | 5 | 4 | 2 |

FIG 14

1)Spring

| Evaluation item | | 13°C | 15°C | 17°C | 19°C | 21°C |
|---|---|---|---|---|---|---|
| Appearance | Luster | 9.90 | 10.20 | 10.80 | 10.00 | 9.00 |
| | Viscosity | 11.60 | 10.80 | 10.50 | 9.70 | 9.00 |
| | Mildness | 9.10 | 9.20 | 9.80 | 8.80 | 8.50 |
| Pick-up | Firmness | 8.00 | 7.50 | 7.00 | 6.50 | 6.00 |
| | Adhesiveness | 7.60 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.70 | 5.80 | 6.00 | 6.30 | 6.50 |
| | Spreadability | 8.00 | 8.30 | 8.50 | 8.10 | 7.80 |
| | Thickness | 9.10 | 8.80 | 8.70 | 8.30 | 7.80 |
| | Moistness | 8.50 | 8.60 | 9.00 | 8.20 | 7.50 |
| | Slipperiness 2 | 4.50 | 4.70 | 5.70 | 5.40 | 5.20 |
| | Absorption rate | 8.50 | 9.20 | 10.80 | 9.60 | 9.20 |
| After-feel | Gloss | 7.50 | 7.80 | 8.70 | 7.80 | 7.40 |
| | Moist feeling | 10.00 | 10.50 | 11.50 | 10.20 | 9.20 |
| | oiliness | 4.20 | 4.30 | 4.70 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 15

2)Summer

| Evaluation item | | 10°C | 13°C | 15°C | 17°C | 19°C |
|---|---|---|---|---|---|---|
| Appearance | Luster | 9.80 | 10.00 | 10.50 | 10.00 | 9.20 |
| | Viscosity | 11.40 | 10.80 | 10.50 | 9.70 | 9.00 |
| | Mildness | 9.10 | 9.20 | 9.50 | 8.80 | 8.50 |
| Pick-up | Firmness | 8.00 | 7.50 | 7.00 | 6.50 | 6.00 |
| | Adhesiveness | 7.20 | 6.80 | 6.50 | 5.70 | 5.40 |
| | cohesiveness | 7.30 | 6.80 | 6.40 | 6.10 | 5.60 |
| Rub-out | Slipperiness 1 | 6.30 | 6.40 | 6.70 | 6.50 | 6.50 |
| | Oiliness | 5.50 | 5.80 | 6.00 | 6.20 | 6.50 |
| | Spreadability | 8.20 | 8.30 | 8.50 | 8.10 | 7.80 |
| | Thickness | 9.20 | 8.80 | 8.50 | 8.00 | 7.80 |
| | Moistness | 8.50 | 8.60 | 8.80 | 8.20 | 7.50 |
| | Slipperiness 2 | 4.50 | 4.70 | 5.50 | 5.40 | 5.20 |
| | Absorption rate | 8.50 | 9.20 | 10.50 | 9.60 | 9.20 |
| After-feel | Gloss | 7.50 | 7.80 | 8.60 | 7.80 | 7.40 |
| | Moist feeling | 10.00 | 10.50 | 11.00 | 10.20 | 9.20 |
| | oiliness | 4.20 | 4.30 | 4.50 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.50 | 8.20 | 7.80 |
| Total feeling | Preference (Perfect score:5) | 3 | 4 | 5 | 4 | 2 |

FIG 16

3)Fall

| Evaluation item | | 13°C | 15°C | 17°C | 19°C | 21°C |
|---|---|---|---|---|---|---|
| Appearance | Luster | 9.90 | 10.20 | 10.80 | 10.00 | 9.00 |
| | Viscosity | 11.60 | 10.80 | 10.50 | 9.70 | 9.00 |
| | Mildness | 9.10 | 9.20 | 9.80 | 8.80 | 8.50 |
| Pick-up | Firmness | 8.00 | 7.50 | 7.00 | 6.50 | 6.00 |
| | Adhesiveness | 7.60 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.70 | 5.80 | 6.00 | 6.30 | 6.50 |
| | Spreadability | 8.00 | 8.30 | 8.50 | 8.10 | 7.80 |
| | Thickness | 9.10 | 8.80 | 8.70 | 8.30 | 7.80 |
| | Moistness | 8.50 | 8.60 | 9.00 | 8.20 | 7.50 |
| | Slipperiness 2 | 4.50 | 4.70 | 5.70 | 5.40 | 5.20 |
| | Absorption rate | 8.50 | 9.20 | 10.80 | 9.60 | 9.20 |
| After-feel | Gloss | 7.50 | 7.80 | 8.70 | 7.80 | 7.40 |
| | Moist feeling | 10.00 | 10.50 | 11.50 | 10.20 | 9.20 |
| | oiliness | 4.20 | 4.30 | 4.70 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.20 | 8.20 | 7.80 |
| Total feeling | Preference . (Perfect score:5) | 3 | 4 | 5 | 4 | 2 |

FIG 17

4)Winter

| Evaluation item | | 14℃ | 16℃ | 18℃ | 20℃ | 22℃ |
|---|---|---|---|---|---|---|
| Appearance | Luster | 9.50 | 10.00 | 10.30 | 10.00 | 9.20 |
| | Viscosity | 11.40 | 10.80 | 10.30 | 9.70 | 9.00 |
| | Mildness | 9.10 | 9.30 | 9.90 | 8.80 | 8.50 |
| Pick-up | Firmness | 8.00 | 7.70 | 7.00 | 6.50 | 6.00 |
| | Adhesiveness | 7.20 | 6.80 | 6.10 | 5.70 | 5.40 |
| | cohesiveness | 7.60 | 6.80 | 6.50 | 6.10 | 5.60 |
| Rub-out | Slipperiness 1 | 6.30 | 6.40 | 6.70 | 6.50 | 6.50 |
| | Oilness | 5.50 | 5.80 | 6.00 | 6.20 | 6.50 |
| | Spreadability | 7.10 | 7.80 | 8.90 | 8.10 | 7.80 |
| | Thickness | 9.20 | 8.80 | 8.50 | 8.00 | 7.80 |
| | Moistness | 8.20 | 8.70 | 9.00 | 8.20 | 7.50 |
| | Slipperiness 2 | 4.50 | 4.90 | 5.80 | 5.40 | 5.20 |
| | Absorption rate | 8.00 | 9.20 | 10.80 | 9.60 | 9.20 |
| After-feel | Gloss | 7.10 | 7.80 | 8.60 | 7.80 | 7.40 |
| | Moist feeling | 10.00 | 10.50 | 11.40 | 10.20 | 9.20 |
| | oilness | 4.20 | 4.50 | 5.00 | 5.10 | 5.50 |
| | Smoothness | 8.50 | 8.90 | 10.10 | 8.60 | 8.20 |
| | Stickiness | 5.50 | 5.40 | 5.30 | 6.20 | 6.50 |
| | Residual feeling | 9.50 | 8.90 | 8.30 | 8.20 | 7.80 |
| Total feeling | Preference (Perfect score:5) | 3 | 4 | 5 | 4 | 2 |

FIG 18

1)Spring

| Evaluation item | | 13°C | 15°C | 17°C | 19°C | 21°C |
|---|---|---|---|---|---|---|
| Appearance | Luster | 9.90 | 10.20 | 10.80 | 10.00 | 9.00 |
| | Viscosity | 11.60 | 10.80 | 10.50 | 9.70 | 9.00 |
| | Mildness | 9.10 | 9.20 | 9.80 | 8.80 | 8.50 |
| Pick-up | Firmness | 8.00 | 7.50 | 7.00 | 6.50 | 6.00 |
| | Adhesiveness | 7.60 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.70 | 5.80 | 6.00 | 6.30 | 6.50 |
| | Spreadability | 8.00 | 8.30 | 8.50 | 8.10 | 7.80 |
| | Thickness | 9.10 | 8.80 | 8.70 | 8.30 | 7.80 |
| | Moistness | 8.50 | 8.60 | 9.00 | 8.20 | 7.50 |
| | Slipperiness 2 | 4.50 | 4.70 | 5.70 | 5.40 | 5.20 |
| | Absorption rate | 8.50 | 9.20 | 10.80 | 9.60 | 9.20 |
| After feel | Gloss | 7.50 | 7.80 | 8.70 | 7.80 | 7.40 |
| | Moist feeling | 10.00 | 10.50 | 11.50 | 10.20 | 9.20 |
| | oiliness | 4.20 | 4.30 | 4.70 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 19

2)Summer

| Evaluation item | | 10℃ | 13℃ | 15℃ | 17℃ | 19℃ |
|---|---|---|---|---|---|---|
| Appearance | Luster | 9.80 | 10.00 | 10.50 | 10.00 | 9.20 |
| | Viscosity | 11.40 | 10.60 | 10.50 | 9.70 | 9.00 |
| | Mildness | 9.10 | 9.20 | 9.50 | 8.80 | 8.50 |
| Pick-up | Firmness | 8.00 | 7.50 | 7.00 | 6.50 | 6.00 |
| | Adhesiveness | 7.20 | 6.80 | 6.50 | 5.70 | 5.40 |
| | cohesiveness | 7.30 | 6.80 | 6.40 | 6.10 | 5.60 |
| Rub-out | Slipperiness 1 | 6.30 | 6.40 | 6.70 | 6.50 | 6.50 |
| | Oiliness | 5.50 | 5.80 | 6.00 | 6.20 | 6.50 |
| | Spreadability | 8.20 | 8.30 | 8.50 | 8.10 | 7.80 |
| | Thickness | 9.20 | 8.80 | 8.50 | 8.00 | 7.80 |
| | Moistness | 8.50 | 8.60 | 8.80 | 8.20 | 7.50 |
| | Slipperiness 2 | 4.50 | 4.70 | 5.50 | 5.40 | 5.20 |
| | Absorption rate | 8.50 | 9.20 | 10.50 | 9.60 | 9.20 |
| After-feel | Gloss | 7.50 | 7.80 | 8.60 | 7.80 | 7.40 |
| | Moist feeling | 10.00 | 10.50 | 11.00 | 10.20 | 9.20 |
| | oiliness | 4.20 | 4.30 | 4.50 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.50 | 8.20 | 7.80 |
| Total feeling | Preference (Perfect score:5) | 3 | 4 | 5 | 4 | 2 |

FIG 20

3)Fall

| Evaluation item | | 13°C | 15°C | 17°C | 19°C | 21°C |
|---|---|---|---|---|---|---|
| Appearance | Luster | 9.90 | 10.20 | 10.80 | 10.00 | 9.00 |
| | Viscosity | 11.60 | 10.80 | 10.50 | 9.70 | 9.00 |
| | Mildness | 9.10 | 9.20 | 9.80 | 8.80 | 8.50 |
| Pick-up | Firmness | 8.00 | 7.50 | 7.00 | 6.50 | 6.00 |
| | Adhesiveness | 7.60 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.70 | 5.80 | 6.00 | 6.30 | 6.50 |
| | Spreadability | 8.00 | 8.30 | 8.50 | 8.10 | 7.80 |
| | thickness | 9.10 | 8.80 | 8.70 | 8.30 | 7.80 |
| | Moistness | 8.50 | 8.60 | 9.00 | 8.20 | 7.50 |
| | Slipperiness 2 | 4.50 | 4.70 | 5.70 | 5.40 | 5.20 |
| | Absorption rate | 8.50 | 9.20 | 10.80 | 9.60 | 9.20 |
| After-feel | Gloss | 7.50 | 7.80 | 8.70 | 7.80 | 7.40 |
| | Moist feeling | 10.00 | 10.50 | 11.50 | 10.20 | 9.20 |
| | oiliness | 4.20 | 4.30 | 4.70 | 5.10 | 5.50 |
| | Smoothness | 8.50 | 8.70 | 9.20 | 8.60 | 8.20 |
| | Stickiness | 5.50 | 5.40 | 5.30 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 21

4)Winter

| Evaluation item | | 14℃ | 16℃ | 18℃ | 20℃ | 22℃ |
|---|---|---|---|---|---|---|
| Appearance | Luster | 9.50 | 10.00 | 10.30 | 10.00 | 9.20 |
| | Viscosity | 11.40 | 10.80 | 10.30 | 9.70 | 9.00 |
| | Mildness | 9.10 | 9.30 | 9.90 | 8.80 | 8.50 |
| Pick-up | Firmness | 8.00 | 7.70 | 7.00 | 6.50 | 6.00 |
| | Adhesiveness | 7.20 | 6.80 | 6.10 | 5.70 | 5.40 |
| | cohesiveness | 7.60 | 6.80 | 6.50 | 6.10 | 5.60 |
| Rub-out | Slipperiness 1 | 6.30 | 6.40 | 6.70 | 6.50 | 6.50 |
| | Oiliness | 5.50 | 5.80 | 6.00 | 6.20 | 6.50 |
| | Spreadability | 7.10 | 7.80 | 8.90 | 8.10 | 7.80 |
| | Thickness | 9.20 | 8.80 | 8.50 | 8.00 | 7.80 |
| | Moistness | 8.20 | 8.70 | 9.00 | 8.20 | 7.50 |
| | Slipperiness 2 | 4.50 | 4.90 | 5.80 | 5.40 | 5.20 |
| | Absorption rate | 8.00 | 9.20 | 10.80 | 9.60 | 9.20 |
| After-feel | Gloss | 7.10 | 7.80 | 8.60 | 7.80 | 7.40 |
| | Moist feeling | 10.00 | 10.50 | 11.40 | 10.20 | 9.20 |
| | oiliness | 4.20 | 4.50 | 5.00 | 5.10 | 5.50 |
| | Smoothness | 8.50 | 8.90 | 10.10 | 8.60 | 8.20 |
| | Stickiness | 5.50 | 5.40 | 5.30 | 6.20 | 6.50 |
| | Residual feeling | 9.50 | 8.90 | 8.30 | 8.20 | 7.80 |
| Total feeling | Preference (Perfect score:5) | 3 | 4 | 5 | 4 | 2 |

FIG 22

1)Spring

| Evaluation Item | | 15℃ | 17℃ | 19℃ | 21℃ | 23℃ |
|---|---|---|---|---|---|---|
| Appearance | Luster | 9.50 | 10.20 | 11.20 | 10.50 | 9.00 |
| | Viscosity | 11.60 | 10.80 | 10.70 | 9.70 | 9.00 |
| | Mildness | 9.30 | 9.20 | 10.00 | 8.80 | 8.50 |
| Pick-up | Firmness | 8.00 | 7.50 | 7.00 | 6.50 | 6.00 |
| | Adhesiveness | 7.80 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.50 | 5.80 | 6.00 | 6.30 | 6.50 |
| | Spreadability | 8.00 | 8.30 | 8.50 | 8.10 | 7.80 |
| | Thickness | 9.30 | 8.80 | 8.50 | 8.30 | 7.80 |
| | Moistness | 8.50 | 8.60 | 9.20 | 8.20 | 7.50 |
| | Slipperiness 2 | 4.50 | 4.70 | 5.90 | 5.40 | 5.20 |
| | Absorption rate | 8.50 | 9.50 | 10.80 | 9.60 | 9.20 |
| After-feel | Gloss | 7.50 | 7.80 | 8.90 | 7.80 | 7.40 |
| | Moist feeling | 10.00 | 10.50 | 11.50 | 10.20 | 9.20 |
| | oiliness | 4.00 | 4.30 | 4.70 | 5.10 | 5.50 |
| | Smoothness | 8.50 | 8.70 | 9.00 | 8.60 | 8.20 |
| | Stickiness | 4.30 | 4.80 | 5.00 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 23

2)summer

| Evaluation item | | 15°C | 17°C | 19°C | 21C° | 23°C |
|---|---|---|---|---|---|---|
| Appearance | Luster | 9.50 | 10.20 | 11.20 | 10.50 | 9.00 |
| | Viscosity | 11.60 | 10.80 | 10.70 | 9.70 | 9.00 |
| | Mildness | 9.30 | 9.20 | 10.00 | 8.80 | 8.50 |
| Pick-up | Firmness | 8.00 | 7.50 | 7.00 | 6.50 | 6.00 |
| | Adhesiveness | 7.80 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.50 | 5.80 | 6.00 | 6.30 | 6.50 |
| | Spreadability | 8.00 | 8.30 | 8.50 | 8.10 | 7.80 |
| | Thickness | 9.30 | 8.80 | 8.50 | 8.30 | 7.80 |
| | Moistness | 8.50 | 8.60 | 9.20 | 8.20 | 7.50 |
| | Slipperiness 2 | 4.50 | 4.70 | 5.90 | 5.40 | 5.20 |
| | Absorption rate | 8.50 | 9.50 | 10.80 | 9.60 | 9.20 |
| After-feel | Gloss | 7.50 | 7.80 | 8.90 | 7.80 | 7.40 |
| | Moist feeling | 10.00 | 10.50 | 11.50 | 10.20 | 9.20 |
| | oiliness | 4.00 | 4.30 | 4.70 | 5.10 | 5.50 |
| | Smoothness | 8.50 | 8.70 | 9.00 | 8.60 | 8.20 |
| | Stickiness | 4.30 | 4.80 | 5.00 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 24

3)Fall

| Evaluation item | | 15℃ | 17℃ | 19℃ | 21℃ | 23℃ |
|---|---|---|---|---|---|---|
| Appearance | Luster | 9.50 | 10.20 | 11.20 | 10.50 | 9.00 |
| | Viscosity | 11.60 | 10.80 | 10.70 | 9.70 | 9.00 |
| | Mildness | 9.30 | 9.20 | 10.00 | 8.80 | 8.50 |
| Pick-up | Firmness | 8.00 | 7.50 | 7.00 | 6.50 | 6.00 |
| | Adhesiveness | 7.80 | 6.80 | 6.50 | 5.70 | 5.40 |
| | cohesiveness | 7.30 | 6.80 | 6.40 | 6.10 | 5.60 |
| Rub-out | Slipperiness 1 | 6.20 | 6.40 | 6.70 | 6.50 | 6.50 |
| | Oiliness | 5.50 | 5.80 | 6.00 | 6.30 | 6.50 |
| | Spreadability | 8.00 | 8.30 | 8.50 | 8.10 | 7.80 |
| | Thickness | 9.30 | 8.80 | 8.50 | 8.30 | 7.80 |
| | Moistness | 8.50 | 8.60 | 9.20 | 8.20 | 7.50 |
| | Slipperiness 2 | 4.50 | 4.70 | 5.90 | 5.40 | 5.20 |
| | Absorption rate | 8.50 | 9.50 | 10.80 | 9.60 | 9.20 |
| After-feel | Gloss | 7.50 | 7.80 | 8.90 | 7.80 | 7.40 |
| | Moist feeling | 10.00 | 10.50 | 11.50 | 10.20 | 9.20 |
| | oiliness | 4.00 | 4.30 | 4.70 | 5.10 | 5.50 |
| | Smoothness | 8.50 | 8.70 | 9.00 | 8.60 | 8.20 |
| | Stickiness | 4.30 | 4.80 | 5.00 | 6.20 | 6.50 |
| | Residual feeling | 9.20 | 8.80 | 8.20 | 8.20 | 7.80 |
| Total feeling | Preference (Perfect score:5) | 3 | 4 | 5 | 4 | 2 |

FIG 25

4)Winter

| Evaluation item | | 16°C | 18°C | 20°C | 22°C | 24°C |
|---|---|---|---|---|---|---|
| Appearance | Luster | 9.50 | 10.00 | 10.70 | 10.00 | 9.20 |
| | Viscosity | 11.40 | 10.80 | 10.30 | 9.70 | 9.00 |
| | Mildness | 9.10 | 9.30 | 10.10 | 8.80 | 8.50 |
| Pick-up | Firmness | 8.00 | 7.70 | 7.00 | 6.50 | 6.00 |
| | Adhesiveness | 7.10 | 6.80 | 6.10 | 5.70 | 5.40 |
| | cohesiveness | 7.60 | 6.80 | 6.50 | 6.10 | 5.60 |
| Rub-out | Slipperiness 1 | 6.30 | 6.40 | 6.70 | 6.50 | 6.50 |
| | Oiliness | 5.50 | 5.80 | 6.00 | 6.30 | 6.50 |
| | Spreadability | 7.10 | 7.80 | 8.90 | 8.10 | 7.80 |
| | Thickness | 9.50 | 8.80 | 8.50 | 8.00 | 7.80 |
| | Moistness | 8.20 | 8.70 | 9.30 | 8.20 | 7.50 |
| | Slipperiness 2 | 4.50 | 4.90 | 5.80 | 5.50 | 5.20 |
| | Absorption rate | 8.00 | 9.20 | 10.50 | 9.60 | 9.20 |
| After-feel | Gloss | 7.10 | 7.80 | 8.40 | 7.80 | 7.40 |
| | Moist feeling | 10.00 | 10.50 | 11.10 | 10.20 | 9.20 |
| | oiliness | 4.20 | 4.60 | 5.00 | 5.10 | 5.50 |
| | Smoothness | 8.50 | 8.90 | 10.10 | 8.60 | 8.20 |
| | Stickiness | 5.50 | 5.40 | 5.60 | 6.20 | 6.50 |
| | Residual feeling | 9.60 | 8.90 | 8.30 | 8.20 | 7.90 |
| Total feeling | Preference (Perfect score:5) | 3 | 4 | 5 | 4 | 2 |

REFRIGERATOR FOR COSMETICS AND METHOD OF CONTROLLING THE SAME

CROSS-REFERENCE TO RELATED APPLICATIONS

This application claims the benefit of Korean Application Nos. 2001-64803 and 2002-18124, filed Oct. 19, 2001 and Apr. 3, 2002, respectively, in the Korean Intellectual Property Office, the disclosures of which are incorporated herein by reference.

BACKGROUND OF THE INVENTION

1. Field of the Invention

The present invention relates to a refrigerator for cosmetics and a method of controlling the same, and specifically, to a refrigerator that optimally preserves cosmetics at a temperature that is best suitable for a user's skin type and a season.

2. Description of the Related Art

In general, cosmetics serve to protect the skin, preserve moisture, and prevent impurities in the atmosphere from being brought into contact with the skin. When cosmetics are used while being kept in the atmosphere, the cosmetics may easily deteriorate by the influence of the atmosphere. If deteriorated cosmetics are used on the skin, pores are plugged, the skin becomes rough and skin diseases may result. It is desirable to preserve cosmetics in a low humidity and cool environment. To this end, there increases a demand for a refrigerator for cosmetics.

SUMMARY OF THE INVENTION

Accordingly, the present invention has been made keeping in mind the above and other problems occurring in the related art, and an object of the present invention is to provide a refrigerator for cosmetics and a control method thereof, where the refrigerator optimally preserves cosmetics at a temperature that is best suitable for a user's skin type and the season.

Additional objects and advantages of the invention will be set forth in part in the description which follows and, in part, will be obvious from the description, or may be learned by practice of the invention.

In order to accomplish the above and other objects, an embodiment of the present invention provides a refrigerator for cosmetics having a storage chamber and a cooling unit to cool the storage chamber, an input unit to receive one or more storage conditions from a user, a storage unit to store storage reference temperatures predetermined to correspond to possible storage conditions, a temperature detecting unit to detect a temperature of the storage chamber; and a control unit to control an operation of the cooling unit based upon the storage conditions inputted through the input unit, a corresponding reference storage temperature stored in the storage unit, and the temperature of the storage chamber detected by the temperature detecting unit.

According to another embodiment of the present invention, a method of controlling a refrigerator for cosmetics, wherein the refrigerator has a storage chamber and a cooling unit to cool the storage chamber, the method comprises setting one or more storage conditions, searching for one of a plurality of reference storage temperatures, each of which are predetermined to correspond to one of a plurality of possible storage conditions, the one reference storage temperature corresponding to the set storage condition, and operating the cooling unit to maintain a temperature of the storage chamber at the searched reference storage temperature.

BRIEF DESCRIPTION OF THE DRAWINGS

The above and other objects, features and other advantages of the present invention will be more clearly understood and more readily appreciated from the following detailed description taken in conjunction with the accompanying drawings, in which:

FIG. 5 is a table showing results of a test to determine skin types, in which subjects who were randomly selected irrespective of their skin types were tested for the feeling on use of the cosmetics to primarily select optimal temperature conditions;

FIGS. 6 to 9 are tables showing test results of the subjects with oily skin type according to spring, summer, fall and winter, respectively;

FIGS. 10 to 13 are tables showing test results of the subjects with combination skin type according to spring, summer, fall and winter, respectively;

FIGS. 14 to 17 are tables showing test results of the subjects with sensitive skin type according to spring, summer, fall and winter, respectively;

FIGS. 18 to 21 are tables showing test results of the subjects with weak dry skin type according to spring, summer, fall and winter, respectively;

FIGS. 22 to 25 are tables showing test results of the subjects with dry skin type according to spring, summer, fall and winter, respectively.

DESCRIPTION OF THE EMBODIMENTS

Figure 1:
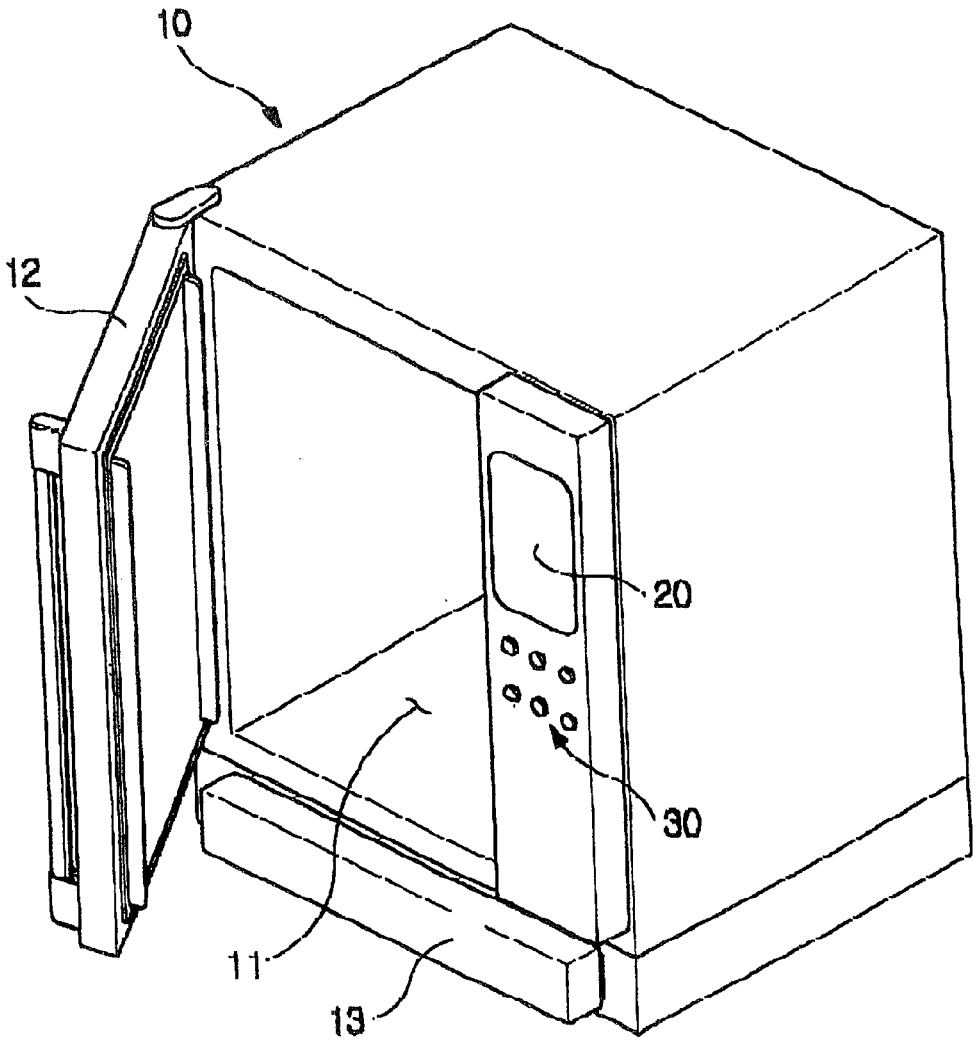
FIG. 1 is a perspective view showing a refrigerator for cosmetics in accordance with an embodiment of the present invention.

Reference will now be made in detail to the present embodiments of the present invention, examples of which are illustrated in the accompanying drawings, wherein like reference numerals refer to like elements throughout. The embodiments are described below in order to explain the present invention by referring to the figures.

FIG. 1 is a perspective view showing a refrigerator for cosmetics in accordance with an embodiment of the present invention. In the refrigerator, a box-shaped cabinet 10 provides a storage chamber 11. A door 12 is positioned at a front opening of the cabinet 10 to open and dose the storage chamber 11. A drawer 13 is provided in a lower portion of the cabinet 10. A display 20 to display information and an input unit 30 to receive commands from a user are formed on one side of the front of the cabinet 10.

Figure 2:
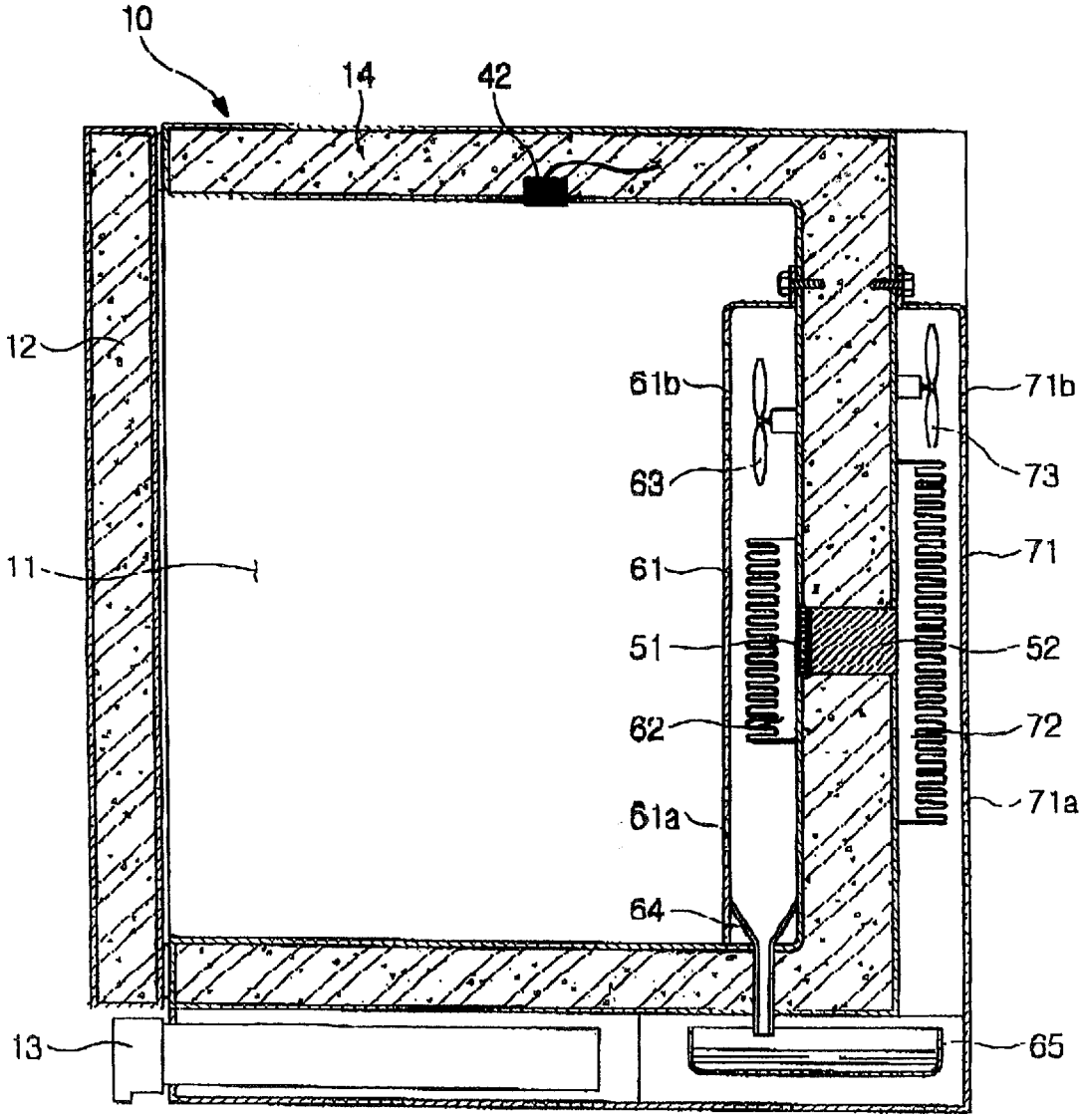
FIG. 2 is a sectional view showing the refrigerator for cosmetics shown in FIG. 1.

FIG. 2 is a sectional view of the refrigerator of FIG. 1. As shown in FIG. 2 and described above, the cosmetic refrigerator includes the cabinet 10. The cabinet 10 includes an insulating wall 14 that is shaped in the form of a box and defines the storage chamber 11 therein. The door 12 is situated in the front opening of the cabinet 10 to selectively open and close the storage chamber 11.

Figure 3:
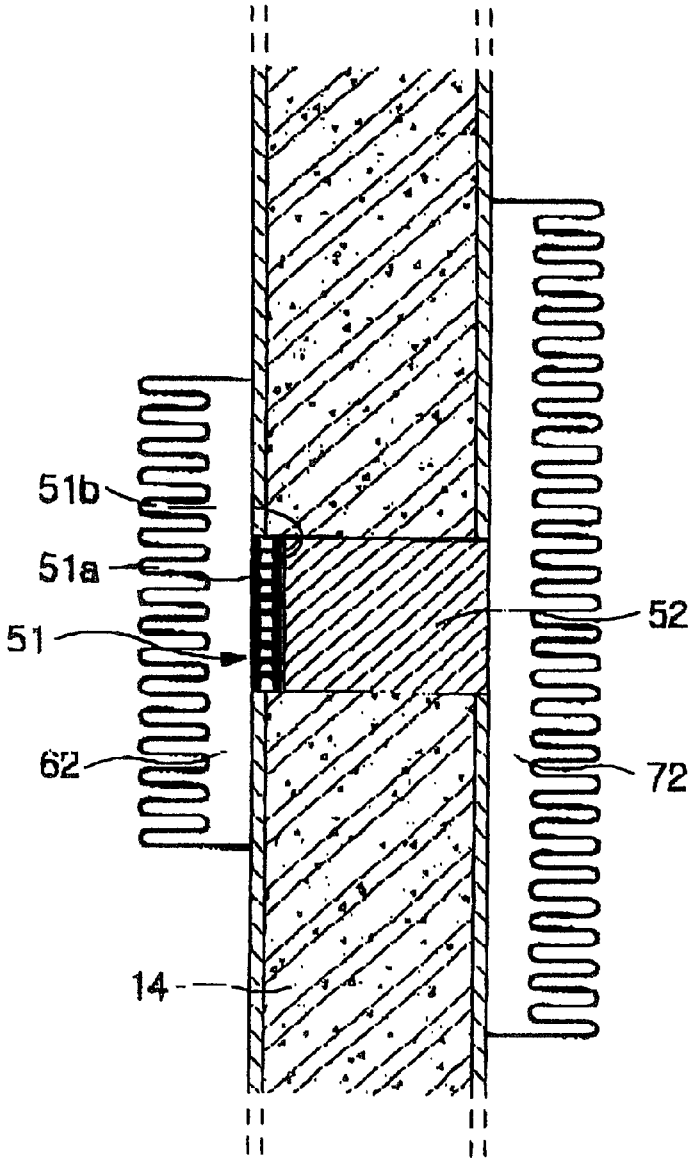
FIG. 3 is a partial enlarged view of the refrigerator shown in FIG. 2.

As also shown in FIG. 3, a thermoelectric element 51 provided with a heat absorbing part 51*b* and a heat emitting part is contained in a rear portion of the insulating wall 14 of the cabinet 10. The heat absorbing part 51*b* of the thermoelectric element 51 is oriented toward the storage chamber 11, and an interior heat exchanger 62 is attached to the heat absorbing part 51*b*. An air blowing fan 63 is mounted on the rear portion of the insulating wall 14 above the interior heat exchanger 62 to circulate the cooling air. The interior heat exchanger 62 and the air blowing fan 63 are surrounded by a cooling air duct 61 in the storage chamber 11.

A cooling air inlet 61*a* is formed in a lower portion of the cooling air duct 61 to suck the cooling air that has been circulated within the storage chamber 11. A cooling air outlet 61*b* is formed in an upper portion of the cooling air duct 61 in the vicinity of the air blowing fan 63 to discharge the cooling air. The discharged cooling air has exchanged heat with the interior heat exchanger 62 prior to being discharged to the storage chamber 11.

The heat emitting unit of the thermoelectric element 51 is oriented with its back toward the storage chamber 11. A thermal conductor 52 and an exterior heat exchanger 72 are attached to the heat emitting unit of the thermoelectric element 51. A heat dissipating fan 73 is mounted on the upper portion of the insulating wall 14 above the external heat exchanger 72. The external heat exchanger 72 and the heat dissipating fan 73 are surrounded by a heat dissipation duct 71. The thermal conductor 52 serves to transfer heat generated in the heat emitting unit of the thermoelectric element 51 to the exterior heat exchanger 72. The thermal conductor 52 is made of aluminum that has excellent heat conductivity according to an embodiment of the invention. However, it is understood that other materials having excellent heat conductivity can be used.

A heat dissipation outlet 71*b* is formed on an upper portion of the heat dissipation duct 71 to discharge air having exchanged heat with the exterior heat exchanger 72 to the outside atmosphere. An outside air inlet 71*a* is formed on a lower portion of the heat dissipation duct 71 to suck air from the outside atmosphere.

A drain part 64 is provided to drain water droplets formed on a surface of the interior heat exchanger 62. A tray 65 is positioned under the cabinet 10 to collect the water droplets drained through the drain part 64. Part of the tray 65 is exposed to the heat dissipation duct 71 to allow the water collected in the tray 65 to be evaporated by heat generated by the exterior heat exchanger 72. The evaporated water is discharged to the heat dissipation outlet 71*b* by the action of the heat dissipating fan 73.

FIG. 3 is a partial enlarged view of the refrigerator of FIG. 2. Referring to FIG. 3, as described above, the thermoelectric element 51 is positioned in a portion of the insulating wall 14. The heat absorbing part 51*b* is oriented in the direction of the storage chamber 11. A heat dissipating part 51*a* is oriented in the opposite direction.

Figure 4:
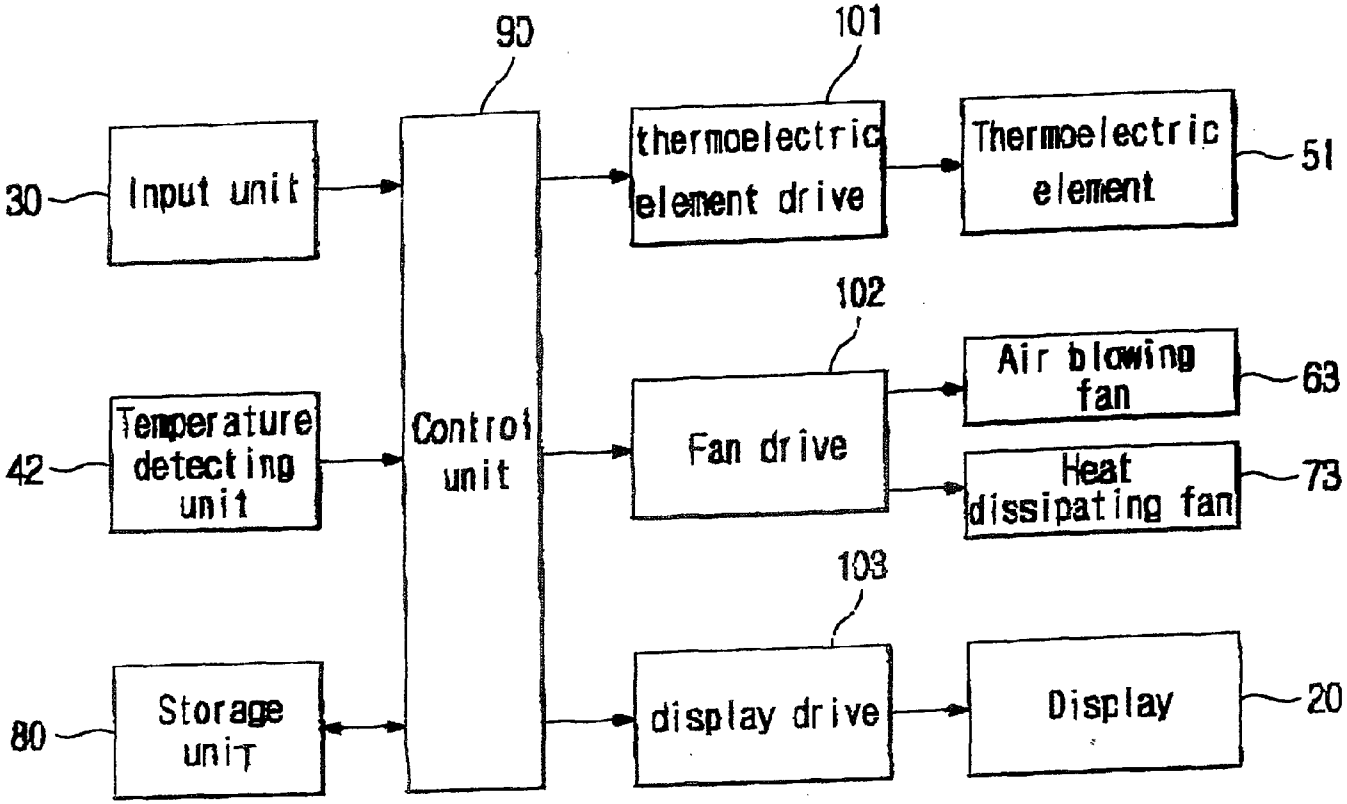
FIG. 4 is a block diagram of the refrigerator for cosmetics in accordance with an embodiment of the present invention

FIG. 4 is a block diagram of the refrigerator for cosmetics in accordance with an embodiment of the present invention. The cosmetic refrigerator includes a control unit 90 to control the overall operation of the refrigerator. The input unit 30, which serves to receive commands and information from a user, is electrically connected to the control unit 90. In detail, the input unit 30 receives skin type information, such as an oily skin, a combination skin, a sensitive skin, a weak dry skin or dry skin, and season information, such as spring, summer, fall, and winter, as well as a variety of operation commands from the user. The input unit 30 includes keys that are separately provided to allow user input. The control unit 90 is understood to be a computer that implements the method shown in FIG. 26 using a computer program encoded on a computer readable medium.

In addition, the cosmetic refrigerator includes a storage unit 80 that stores temperature data for the storage chamber 11. The temperature data is preset according to skin types and seasons. The cosmetic refrigerator further includes a thermoelectric element drive 101 connected to the control unit 90 to operate the thermoelectric element 51, a fan drive 102 to operate the air blowing fan 63 and the heat dissipating fan 73, and a display drive 103 to operate the display 20.

On the whole, cosmetics are defined as chemical articles that are applied to the body, with the aesthetic aim of beautifying the body to appeal to others, with few, if any, negative effects on the body and/or with the healthful aim of cleansing or making healthy the outer body, such as the skin and the hair. Generally, the quality of cosmetics is determined according to function, guarantee, organoleptic and emotional aspects. In an aspect of function, cosmetics are required to maintain the skin in a beautiful and attractive state. Also, cosmetics are required to guarantee safety of the skin, including no occurrence of side effects and protection from microorganism infection and to prevent harm due to sunlight. The organoleptic quality of cosmetics is determined by evaluating the agreeability of the cosmetics to the human senses, including the senses of touch, sight and smell, and the senses concerning coolness and warmness. The emotional quality is concerned with psychological feelings obtained during the use of the cosmetics.

These four qualities are not independent, but are closely connected with one another. In surveys of customers to determine factors affecting their choice in the purchase cosmetics, most answers related to feelings on use. Thus, the feeling upon application of the cosmetic to the skin is the most important factor determining which cosmetics are purchased, as opposed to the functional quality of cosmetics.

The feeling on use of the cosmetics differs from person to person and is greatly affected by the environment. The personal differences depend on age, skin type, skin thickness, and skin sensitivity, while environmental factors include weather conditions and environmental pollution of the place where the consumers live.

In accordance with an embodiment of the present invention, a refrigerator stores the cosmetics under such optimal conditions. The optimal conditions are set based on temperature data with parameters related to personal skin types and seasonal temperature changes, so that the cosmetics can provide consumers with the best possible feeling on use.

Objective data necessary to optimize the feeling on use of the cosmetics by consumers are obtained using five parameters: appearance, pick-up, preparation for rub-out, rub-out, and after-feel.

1. Appearance: After being charged to a certain height in a predetermined vessel, cosmetics are evaluated for their appearances on an organoleptic test die under a light. No limitation is placed on the evaluation time.

Details for appearance evaluation include luster, viscosity, and mildness. First, the luster indicates the degree to which light is reflected from the article as observed with the naked eye. The luster is graded zero (no luster) to 14 (high luster). Second, the viscosity is a concept opposite to the fluidity of the article and is graded zero (no viscosity) to 14 (high viscosity). Finally, mildness reflects the perceived texture of the article or the uniformity of constituent particles.

2. Pick-up: Pick-up is evaluated at the stage of taking up a cosmetic material from a certain vessel by the fingers. The forces and sensations felt when the fingers are brought into contact with the cosmetic material and when the fingers with a part of the cosmetic material attached are separated from the cosmetic material pool, and the quantity of the material picked up on the fingers, are all parameters for evaluation.

The pick-up item is evaluated in terms of firmness, adhesiveness and cohesiveness. First, firmness indicates the hardness felt upon pressing the material with the fingers, and is graded zero (soft) to 14 (hard). Second, adhesiveness indicates the difficulty felt upon separating the fingers from the cosmetic material contained in a vessel and is graded zero (easy) to 14 (difficult). Cohesiveness means the extent to which particles of the cosmetic material conglomerate to each other, and is graded zero (no conglomeration) to 14 (extensive conglomeration).

3. Preparation for Rub-out: The skin area where cosmetic materials are applied is on the back of the hand. The skin area is marked in a dimension of 4×4 $cm^2$ and cleansed with 70% alcohol. After 1 min, a 50 $\mu$l aliquot of the cosmetic materials is applied to the cleansed area.

4. Rub-out: This test is concerned with the feeling for 2 min after the application of cosmetics. Based on the feeling for 10 sec after application, the rub-out is evaluated in terms of the following items, except 'slipperiness 2' and 'absorption rate'. The slipperiness 2 is checked only if the feeling obtained at 10–20 sec after the application is quite different from that obtained for the first 10 sec. The absorption rate is evaluate at 2 minutes after the application of cosmetics.

As parameters for the rub-out test, there are adopted slipperiness 1, oiliness, spreadability, thickness, moistness, slipperiness 2, and absorption rate. As mentioned above, slipperiness 1, oiliness, spreadability, thickness, and moistness are determined by those obtained for the first 10 sec.

a. Slipperiness 1 is to quantify the extent to which cosmetics are slippery on the skin (cosmetics are not or are slowly absorbed into the skin owing to their high oil content or for other reasons, remaining incompatible with the skin, that is, slippery), and is graded zero (not slippery) to 14 (highly slippery).

b. Oiliness, which measures the greasy feeling obtained during the application of the cosmetic, is graded zero (not oily) to 14 (highly oily).

c. Spreadability measures the ease felt upon application of cosmetics to the skin and is graded zero (stiff) to 14 (highly spreadable).

d. Thickness is concerned with the heaviness or closeness felt during the application and is graded zero (none) to 14 (very high).

e. Moistness is concerned with the moisture content felt during the application and is graded zero (none) to 14 (very high).

f. Slipperiness 2 is to quantify the change in slipperiness felt upon the application of cosmetics (this is measured in the case that there is a large change in slipperiness 30 sec after the application) and is graded zero (not slippery) to 14 (highly slippery).

g. Absorption rate is determined by the time it takes to reach the point of disappearance of the cosmetics into the skin, no detection of the feeling of moistness, and no detection of resistance upon spreading the cosmetics on the skin with fingers, and is graded zero (slow) to 14 (fast).

5. After-feel: This test is concerned with the feeling 2 minutes after the application of cosmetics. The after-feel parameters include gloss, moist feeling, oiliness, smoothness, stickiness, and residual feeling.

a. Gloss is to quantify the degree to which light is reflected from the skin as observed with the naked eye, and is graded zero (no gloss) to 14 (high gloss)

b. Moist feeling is concerned with the feeling related to moisture, moisture+oil, and oil, felt on the skin area applied with cosmetics, and is graded zero (no moistness) to 14 (high moistness).

c. Oiliness is concerned with the oily feeling felt on the skin area applied with cosmetics, and is graded zero (no oiliness) to 14 (high oiliness).

d. Smoothness expresses the softness (slipperiness+smoothness) of the skin applied with cosmetics, and is graded zero (no smoothness) to 14 (high smoothness).

e. Stickiness expresses the degree to which the fingers are stuck to the applied skin area, and is graded zero (no stickiness) to 14 (high stickiness).

f. Residual feeling is concerned with the weighty sensation or closeness felt after the absorption of cosmetics into the skin, based on the relative difference from the skin applied with no cosmetics, and is graded zero (no difference in feeling) to 14 (large difference in feeling).

Subject groups (professional panels), each consisting of 20 persons according to skin types, who are sensitive to all of the test items were tested using skin lotions and milk lotions, and the results are shown in FIGS. 5 to 26.

First, before a test used to determine their skin types, 20 subjects were randomly selected irrespective of their skin types and were tested for the feeling on use of the cosmetics to primarily select optimal temperature conditions. The results of the test are given in FIG. 5. Higher grades in the test items gloss, smoothness, spreadability, moistness, absorption rate, and moist feeling indicate better cosmetics. Also, lower grades in the test items oiliness, stickiness, and residual feeling are detected from better cosmetic products. Optimal points were found in the test items viscosity, firmness, adhesiveness, cohesiveness, and slipperiness 1, as shown in the preference test of FIG. 5. In the test, the optimal temperatures were determined on the basis of the temperatures at which the test items gloss, smoothness, spreadability, moistness, and absorption rate are graded high and at which the test items oiliness, stickiness and residual feeling are graded low. Total points are expressed as the test item preference.

As is apparent from FIG. 5, the optimal temperature points fall within the range of 10–20° C. Based on this data, detailed tests were conducted according to skin types and seasons.

FIGS. 6 to 9 give test results of the subjects with oily skin type according to spring, summer, fall and winter, respectively. The results demonstrate that optimal temperatures for oily skin type, as measured by the preference, are 17° C., 15° C., 17° C., and 18° C. in spring, summer, fall and winter, respectively.

FIGS. 10 to 13 give test results of the subjects with combination skin type according to spring, summer, fall and winter, respectively. The results demonstrate that optimal temperatures for combination skin type, as measured by the preference, are 17° C., 15° C., 17° C., and 18° C. for spring, summer, fall and winter, respectively.

FIGS. 14 to 17 give test results of the subjects with sensitive skin type according to spring, summer, fall and winter, respectively. The results demonstrate that optimal temperatures for sensitive skin type, as measured by the preference, are 17° C., 15° C., 17° C., and 18° C. in spring, summer, fall and winter, respectively.

FIGS. 18 to 21 give test results of the subjects with weak dry skin type according to spring, summer, fall and winter, respectively The results demonstrate that optimal temperatures for weak dry skin type, as measured by the preference, are 17° C., 15° C., 17° C., and 18° C. for spring, summer, fall and winter, respectively.

FIGS. 22 to 25 give test results of the subjects with dry skin type according to spring, summer, fall and winter, respectively. The results demonstrate that optimal temperatures for dry skin type, as measured for the preference, are 19° C., 17° C., 17° C., and 18° C. for spring, summer, fall and winter, respectively.

The optimal temperature conditions, taken together from the above tests, are summarized in Table 1, below. This temperature condition data is stored at the storage 80.

TABLE 1

Temperature Condition According to Skin Types and Seasons

| | | Season | | | |
|---|---|---|---|---|---|
| | | Spring | Summer | Fall | Winter |
| Skin type | Oily skin | 15° C. | 13° C. | 15° C. | 16° C. |
| | Combination skin | 17° C. | 15° C. | 17° C. | 18° C. |
| | Sensitive skin | 17° C. | 15° C. | 17° C. | 18° C. |
| | Weak dry skin | 17° C. | 15° C. | 17° C. | 18° C. |
| | Dry skin | 19° C. | 17° C. | 19° C. | 20° C. |

Figure 26:
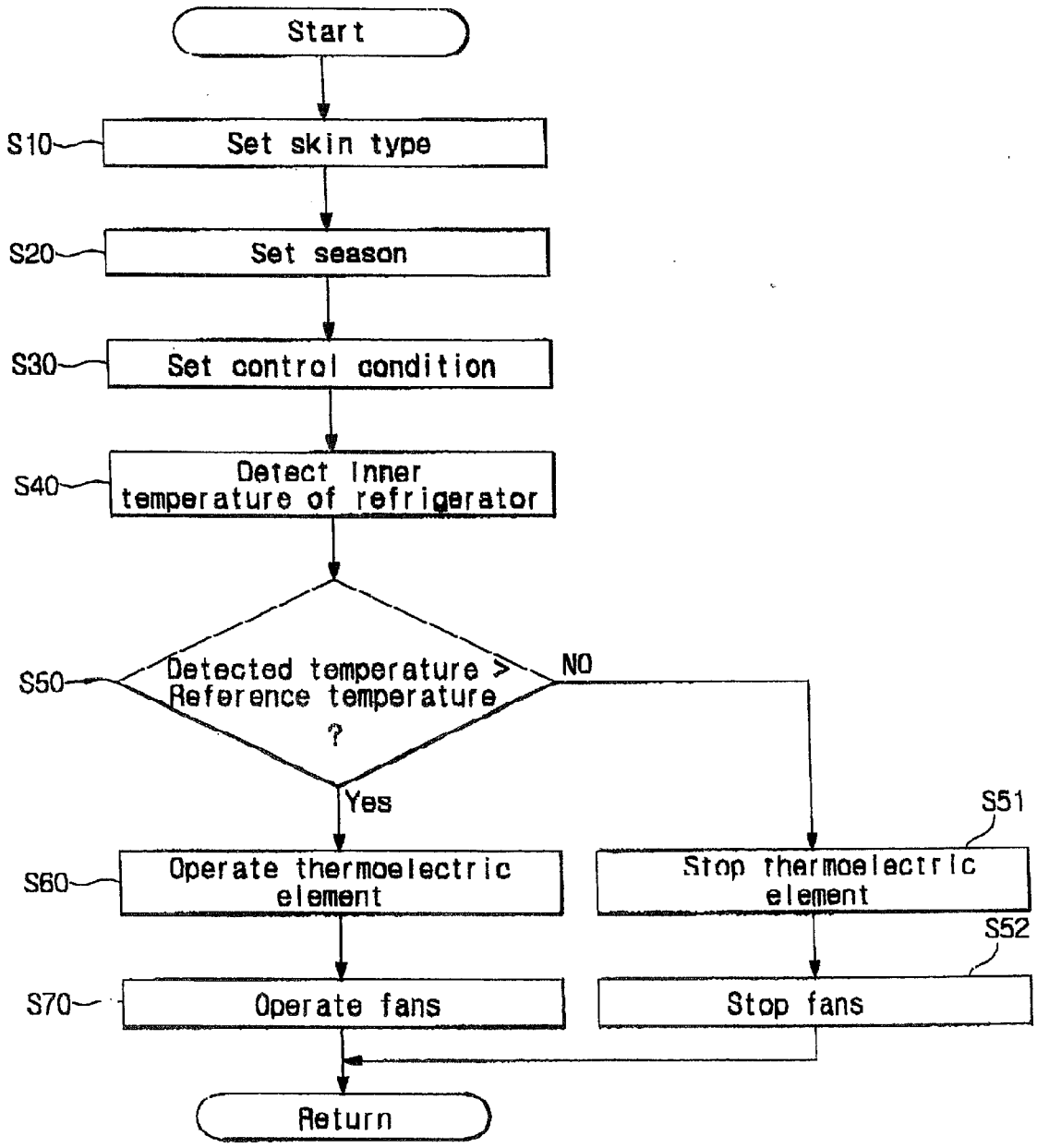
FIG. 26 is a flowchart showing a method of controlling the refrigerator for cosmetics in accordance with an embodiment of the present invention.

Hereinafter, a method of controlling a cosmetic refrigerator in accordance with the present invention is described. FIG. 26 is a flowchart showing a method of controlling a cosmetic refrigerator according to an embodiment of the present invention.

A user inputs information on the user skin type through the input unit 30. At this time, the user can input information, such as whether the skin type is an oily skin, a combination skin, a sensitive skin, a weak dry skin or a dry skin. The input unit 3 transmits the skin type information to the control unit 90. The control unit 90 receives the skin type information transmitted from the input unit 3, and sets the skin type of the user (operation S10). Additionally, the user inputs information on a current season. At this time, the user can input information, such as spring, summer, fall or winter. The input unit 30 transmits the current season information to the control unit 90. The control unit 90 receives the current season information transmitted from the input unit 3, and sets the current season (operation S20).

Thereafter, the control unit 90 reads out a reference internal temperature of a cosmetic refrigerator corresponding to the set skin type and the set current season from a table in which a plurality of reference internal temperatures are predetermined to correspond to possible skin types and seasons, and sets a control condition (operation S30).

The control unit 90 detects an internal temperature of the cosmetic refrigerator through the temperature detecting unit 42 (operation S40). The control unit 90 compares the detected temperature with the temperature of the control condition set (operation S30). To this end, in operation S50, the control unit 90 determines whether the temperature detected through the temperature detecting unit 42 (operation S40) is higher than the temperature of the control condition set (operation S30).

If it is determined that the detected temperature is higher than the temperature of the control condition (operation S50), the control unit 90 controls the thermoelectric element drive unit 101 so that the thermoelectric element drive 101 operates the thermoelectric element 51 (operation S60). Additionally, the control unit 90 controls the fan drive unit 102 so the fan drive unit 102 operates the air blowing fan 63 and the heat dissipating fan 73 (operation S70).

When the thermoelectric element 51 is operated, the heat absorbing part 51*a* thereof serves to absorb heat, while the heat emitting part 51*b* thereof serves to emit heat. At this time, by the operation of the air blowing fan 63, the air in the storage chamber 11 is sucked through cooling air inlet 61*a* of the cooling air duct 61, cooled by heat exchange with the interior heat exchanger 62, and discharged to the storage chamber 11 through the cooling outlet 61*b* of the cooling air duct 61. Any moisture contained in the air forms water droplets on the interior heat exchanger 62 by the heat exchanging operation thereof. The water droplets formed on the interior heat exchanger 62 are collected in the tray 65 through the drain part 64. As a result, the moisture contained in the storage chamber 11 can be reduced easily and effectively by the cosmetic refrigerator and control method thereof according to the present invention.

In addition, by the operation of the heat dissipating fan 73, the outside air is sucked through the outside air inlet 71*a* formed on the heat dissipation duct 71, heated by heat exchange with the exterior heat exchanger 72, and discharged through the heat dissipation outlet 71*b* to the outside. At this time, any water collected in the tray 65 is evaporated by heat transferred from the exterior heat exchanger 72, and is discharged through the heat dissipation outlet 71*b*.

If it is determined that the detected temperature is not higher than the temperature of the control condition (operation S50), the control unit 90 controls the thermoelectric element drive unit 101 so that the thermoelectric element drive 101 stops the thermoelectric element 51 (operation S51). Additionally, the control unit 90 controls the fan drive unit 102 so that the fan drive unit 102 stops the air blowing fan 63 and the heat dissipating fan 73 (operation S52).

As described above, the present invention provides a refrigerator for cosmetics and a method of controlling the same, where cosmetics can be preserved at a desired temperature according to a user's skin type and a current season, thus maximally improving a feeling of use of cosmetics, and in which cosmetics can be preserved at a low temperature and a low humidity.

Although the preferred embodiments of the present invention have been disclosed for illustrative purposes, those skilled in the art will appreciate that various modifications, additions and substitutions are possible, without departing from the scope and spirit of the invention as disclosed in the accompanying claims and equivalents thereof.

What is claimed is:

1. A refrigerator for cosmetics, comprising:

a storage chamber to store the cosmetics;

a cooling unit to cool said storage chamber;

an input unit to receive a storage condition from a user;

a storage unit to store predetermined reference storage temperatures that correspond to possible storage conditions;

a temperature detecting unit to detect a temperature of said storage chamber; and a control unit to control an operation of said cooling unit based upon the input storage condition inputted through said input unit, one of the reference storage temperatures stored in said storage unit that corresponds to the input storage condition, and the detected temperature of said storage chamber as detected by said temperature detecting unit.

2. The refrigerator according to claim 1, wherein the input storage condition is a personal condition or an environmental condition.

3. The refrigerator according to claim 1, wherein:

the user inputs another storage condition through said input unit, the input storage condition is a personal condition, and the input another storage condition is an environmental condition.

4. The refrigerator according to claim 2, wherein the personal condition is a skin type that corresponds to one of an oily skin, a combination skin, a sensitive skin, a weak dry skin and a dry skin.

5. The refrigerator according to claim 2, wherein the environmental condition is a season that corresponds to one of spring, summer, fall and winter.

6. The refrigerator according to claim 1, wherein said cooling unit comprises a thermoelectric element having a heat absorbing part that is oriented toward said storage chamber to cool said storage chamber.

7. The refrigerator according to claim 6, further comprising:

an interior heat exchanger brought into contact with the heat absorbing part of the thermoelectric element to cool air by heat exchange;

an air blowing fan to circulate the air cooled by said interior heat exchanger within said storage chamber;

a cooling air duct that surrounds the thermoelectric element, said interior heat exchanger and said air blowing fan, said cooling air duct comprising an air inlet to suck the air from said storage chamber and an air outlet to discharge the air cooled by said interior heat exchanger;

an exterior heat exchanger brought into contact with the heat emitting part of the thermoelectric element to exchange heat with outside air;

a heat dissipating fan to circulate the outside air to exchange heat with said exterior heat exchanger; and a heat dissipation duct that surrounds said exterior heat exchanger and said heat dissipating fan, said heat dissipation duct comprising an air inlet to suck the air from the outside and an air outlet to discharge the air heated by said exterior heat exchanger.

8. The refrigerator according to claim 7, further comprising a drain part formed in a lower portion of said cooling air duct to discharge water droplets formed on said interior heat exchanger and a tray to collect the water droplets discharged through said drain part.

9. The refrigerator according to claim 8, wherein said tray is partially exposed to said heat dissipation duct so that the water droplets collected in said tray are evaporated by the heat generated by said exterior heat exchanger.

10. A method of controlling a refrigerator for cosmetics, the refrigerator having a storage chamber and a cooling unit to cool the storage chamber, the method comprising:

setting a storage condition;

retrieving one of a plurality of predetermined reference storage temperatures, each of which corresponds to one of a plurality of possible storage conditions, where the one reference storage temperature corresponds to the set storage condition; and operating the cooling unit to maintain a temperature of the storage chamber at the retrieved one reference storage temperature.

11. The method according to claim 10, wherein the set storage condition is a personal condition or an environmental condition.

12. The method according to claim 10, further comprising setting another storage condition, wherein the set storage condition is a personal condition and the another set storage condition is an environmental condition.

13. The method according to claim 11, wherein the personal condition is a skin type that corresponds to one of an oily skin, a combination skin, a sensitive skin, a weak dry skin and a dry skin.

14. The method according to claim 11, wherein the environmental condition is a season that corresponds to one of spring, summer, fall and winter.

15. The refrigerator according to claim 3, wherein the personal condition is a skin type that corresponds to one of an oily skin, a combination skin, a sensitive skin, a weak dry skin and a dry skin.

16. The refrigerator according to claim 3, wherein the environmental condition is a season that corresponds to one of spring, summer, fall and winter.

17. The method according to claim 12, wherein the personal condition is a skin type that corresponds to one of an oily skin, a combination skin, a sensitive skin, a weak dry skin and a dry skin.

18. The method according to claim 12, wherein the environmental condition is a season that corresponds to one of spring, summer, fall and winter.

19. A computer readable medium encoded with processing instructions for implementing a method of controlling a refrigerator for cosmetics, the refrigerator having a storage chamber and a cooling unit to cool the storage chamber performed by a computer, the method comprising:

receiving an input storage condition;

retrieving one of a plurality of predetermined reference storage temperatures, each of which corresponds to one of a plurality of possible storage conditions, where the one reference storage temperature corresponds to the input storage condition; and operating the cooling unit to maintain a temperature of the storage chamber at the retrieved one reference storage temperature.

20. The computer readable medium according to claim 19, wherein the storage condition is a personal condition or an environmental condition.

21. The computer readable medium according to claim 19, further comprising setting another storage condition, wherein the storage condition is a personal condition and the another storage condition is an environmental condition.

22. The computer readable medium according to claim 20, wherein the personal condition is a skin type that corresponds to one of an oily skin, a combination skin, a sensitive skin, a weak dry skin and a dry skin.

23. The computer readable medium according to claim 20, wherein the environmental condition is a season that corresponds to one of spring, summer, fall and winter.

24. The computer readable medium according to claim 21, wherein the personal condition is a skin type that corresponds to one of an oily skin, a combination skin, a sensitive skin, a weak dry skin and a dry skin.

25. The computer readable medium according to claim 21, wherein the environmental condition is a season that corresponds to one of spring, summer, fall and winter.

26. The computer readable medium according to claim 19, further comprising detecting the temperature of the storage chamber, wherein said operating the cooling unit comprises comparing the detected temperature with the retrieved one reference storage temperature, and starting and stopping the cooling unit according to the comparison.

27. A refrigerator for cosmetics, comprising:

a storage chamber to store the cosmetics;

an environmental control unit to adjust the environment in said storage chamber;

an input unit to receive a desired storage condition;

a storage unit to store predetermined environmental conditions that correspond to possible storage conditions;

a detecting unit to detect a state of the environment in said storage chamber; and a control unit to retrieve one of the predetermined environmental conditions corresponding to the desired storage condition, and to control an operation of said environmental control unit according to the detected state of the environment and the retrieved one predetermined environmental condition.

28. The refrigerator according to claim 27, wherein the stored predetermined environmental conditions relate a required temperature in said storage chamber to atmospheric conditions and to a skin type of a user.

29. The refrigerator according to claim 28, wherein the stored predetermined environmental conditions comprise survey results relating the required temperature, the atmospheric conditions according to a time of the year, and to the skin type of the user.

30. The refrigerator according to claim 27, wherein said environmental control unit comprises a heat exchanger that transfers heat from said storage chamber in order to maintain a low humidity in said storage chamber according to the retrieved one predetermined environmental condition.

31. The refrigerator according to claim 27, wherein said environmental control unit comprises a heat exchanger that transfers heat from said storage chamber in order to maintain a temperature in said storage chamber according to the retrieved one predetermined environmental condition.

* * * * *